US010046219B2

(12) United States Patent
Centa et al.

(10) Patent No.: US 10,046,219 B2
(45) Date of Patent: Aug. 14, 2018

(54) ANIMATED TARGET GAME

(71) Applicant: Thomas Centa, Willoughby, OH (US)

(72) Inventors: Thomas Centa, Willoughby, OH (US); Kenneth Cifra, Geneva, OH (US); Matt Dugas, Valley View, OH (US)

(73) Assignee: Thomas Centa, Willoughby, OH (US)

( * ) Notice: Subject to any disclaimer, the term of this patent is extended or adjusted under 35 U.S.C. 154(b) by 0 days.

(21) Appl. No.: 15/341,920

(22) Filed: Nov. 2, 2016

(65) Prior Publication Data

US 2017/0120127 A1 May 4, 2017

Related U.S. Application Data

(60) Provisional application No. 62/250,148, filed on Nov. 3, 2015.

(51) Int. Cl.

| | |
|---|---|
| ***A63B 67/06*** | (2006.01) |
| ***A63B 71/02*** | (2006.01) |
| *F41J 7/04* | (2006.01) |

(52) U.S. Cl.

CPC ..... *A63B 67/06* (2013.01); *A63B 71/023* (2013.01); *A63B 2209/10* (2013.01); *A63B 2210/50* (2013.01); *A63B 2210/58* (2013.01); *F41J 7/04* (2013.01)

(58) Field of Classification Search

CPC ..... F41J 7/00; F41J 7/04; F41J 7/06; A63B 69/004; A63B 69/20; A63B 69/203; A63F 9/0204

USPC ..... 273/386, 390–392, 406, 407; 446/365, 446/379, 380; 482/83, 86, 87

See application file for complete search history.

(56) References Cited

U.S. PATENT DOCUMENTS

| | | | | | |
|---|---|---|---|---|---|
| 450,769 | A * | 4/1891 | Koch | A63B 69/345 | 73/379.05 |
| 906,392 | A * | 12/1908 | Dietz | F41G 3/26 | 434/11 |
| 1,080,299 | A | 12/1913 | Richmond | | |
| 1,170,828 | A * | 2/1916 | Lamb | A63F 9/02 | 273/334 |
| 1,250,215 | A * | 12/1917 | Panos | A63F 9/02 | 273/368 |
| 1,266,494 | A * | 5/1918 | Lakin | F41J 5/18 | 273/381 |
| 1,754,030 | A * | 4/1930 | Mattson | F41J 5/18 | 273/391 |
| 1,989,216 | A | 1/1935 | Shaw et al. | | |

(Continued)

FOREIGN PATENT DOCUMENTS

| | | |
|---|---|---|
| CA | 2036000 C | 4/2000 |
| CA | 2843498 A1 | 2/2012 |

(Continued)

*Primary Examiner* — Mark Graham

(74) *Attorney, Agent, or Firm* — Hahn Loeser & Parks LLP

(57) ABSTRACT

This invention relates in general to target games and methods for animating a target game and playing an animated target game. In the present invention, a game with an animated component comprises a target structure having a first target surface and a second target surface. In some embodiments, the first target surface is separated from the second target surface by a joint. An animation mechanism is provided for moveably connecting the first target surface to the second target surface at the joint.

19 Claims, 9 Drawing Sheets

(56) References Cited

U.S. PATENT DOCUMENTS 2,672,344 A 3/1954 Wakefield
2,819,903 A * 1/1958 Saunders ..... F41J 13/02 273/386
3,599,977 A 8/1971 Glass et al.
3,656,748 A 4/1972 Howard
3,677,545 A 7/1972 Breslow
3,742,642 A 7/1973 Zegers-Ten Horn
3,817,526 A 6/1974 Bibb
3,837,650 A 9/1974 Haney
3,883,140 A 5/1975 Becker
3,887,183 A * 6/1975 Saso ..... A63D 9/00 273/386
3,892,407 A 7/1975 Higgins
3,975,014 A 8/1976 Ryan et al.
4,087,091 A 5/1978 DeLorge
4,266,780 A * 5/1981 McQuary ..... F41J 3/0076 235/121
4,384,723 A 5/1983 Anderson
4,657,261 A * 4/1987 Saunders ..... F41J 7/04 273/392
4,702,472 A * 10/1987 Anquetil ..... A63B 69/34 482/83
4,709,929 A 12/1987 Mills et al.
4,726,592 A 2/1988 Callaham
4,736,955 A 4/1988 Pollock
4,890,845 A 1/1990 Gatewood
4,911,453 A * 3/1990 Essex ..... F41J 7/06 273/359
4,923,201 A 5/1990 Nichol et al.
4,927,160 A 5/1990 Nichol et al.
4,927,161 A 5/1990 Brenneman
4,943,065 A 7/1990 DeLapa
4,961,586 A 10/1990 Conville
4,986,549 A 1/1991 Kuhtic et al.
5,056,796 A 10/1991 Conville
5,165,695 A 11/1992 Yoder
5,332,230 A 7/1994 Benedict
5,382,028 A 1/1995 Sciandra et al.
5,492,320 A 2/1996 Hoffman et al.
5,632,110 A * 5/1997 Roy ..... A01M 31/06 43/2
5,692,979 A 12/1997 Jones
5,746,671 A 5/1998 Ritchie
5,850,885 A 12/1998 Clark et al.
5,871,216 A 2/1999 Sparacino
6,244,598 B1 6/2001 Conville
6,543,775 B1 4/2003 Bell, Jr.
6,620,063 B1 9/2003 Benjamin
6,776,418 B1 * 8/2004 Sovine ..... F41J 1/10 273/407
6,958,022 B2 10/2005 O'Neill et al.
7,100,921 B2 9/2006 Yercha et al.
7,101,293 B2 9/2006 Tarng et al.
7,401,785 B1 7/2008 Waite
7,775,525 B2 8/2010 Staver et al.
7,784,795 B1 8/2010 Liao
7,850,551 B2 12/2010 Barber
7,887,059 B2 2/2011 Kiernan
7,950,666 B2 * 5/2011 Stincelli ..... F41J 7/04 273/386
8,096,557 B2 1/2012 Lin
8,152,587 B1 4/2012 Brown
8,157,265 B2 4/2012 Conville et al.
8,465,022 B2 6/2013 Weiss et al.
8,657,293 B2 2/2014 Sindaco
D706,353 S 6/2014 Montenare
D706,354 S 6/2014 Montenare
D706,355 S 6/2014 Montenare
8,764,017 B2 7/2014 Manner et al.
8,770,586 B2 7/2014 Kody et al.
8,807,565 B2 8/2014 Monopoli
8,807,569 B1 8/2014 Davis
8,814,642 B2 8/2014 Boi
8,915,498 B2 12/2014 Hynds
2004/0108652 A1 6/2004 Vaden
2004/0160012 A1 8/2004 Steiner
2005/0282665 A1 12/2005 Tarng et al.
2006/0091608 A1 5/2006 Yercha et al.
2006/0183577 A1 8/2006 DuFlon et al.
2006/0247072 A1 11/2006 Combs et al.
2006/0255537 A1 11/2006 Gandley
2007/0001399 A1 1/2007 Staver et al.
2007/0249473 A1 * 10/2007 Robinson ..... A63B 69/004 482/83
2008/0042360 A1 2/2008 Veikley
2008/0157476 A1 7/2008 Striebel et al.
2009/0051133 A1 2/2009 Oshiro
2009/0062002 A1 3/2009 Kotlarik et al.
2009/0115136 A1 5/2009 Voden
2009/0174142 A1 7/2009 Sullivan
2009/0174145 A1 7/2009 Staver et al.
2009/0253541 A1 10/2009 Darville
2009/0295093 A1 12/2009 Kiernan
2010/0050926 A1 3/2010 Volack et al.
2010/0140873 A1 6/2010 Britton et al.
2010/0164175 A1 7/2010 Buchanan
2010/0194047 A1 8/2010 Sauerwine
2010/0275641 A1 11/2010 Manner et al.
2010/0320692 A1 12/2010 Tookey
2011/0074106 A1 3/2011 Allshouse
2011/0193287 A1 8/2011 Hopkins et al.
2011/0215528 A1 9/2011 Conville et al.
2011/0291357 A1 12/2011 Boyle
2012/0038109 A1 2/2012 Battista
2012/0169012 A1 7/2012 Parker et al.
2012/0193873 A1 8/2012 Sindaco
2012/0235356 A1 9/2012 Weiss et al.
2012/0292851 A1 11/2012 Monopoli
2013/0001878 A1 1/2013 Kody et al.
2013/0026713 A1 1/2013 Angel
2013/0043655 A1 2/2013 Dolan
2013/0082442 A1 4/2013 Hanel
2013/0130759 A1 5/2013 Boi
2013/0234394 A1 9/2013 Voden
2014/0015198 A1 1/2014 Francis
2014/0024503 A1 * 1/2014 Chiang ..... A63B 69/004 482/83
2014/0038731 A1 2/2014 Manner et al.
2014/0070486 A1 3/2014 Monopoli
2014/0091525 A1 4/2014 Ramirez
2014/0091526 A1 4/2014 Nally
2014/0151963 A1 6/2014 Bennett
2014/0221171 A1 * 8/2014 Siklosi ..... A63B 69/004 482/87
2014/0239592 A1 8/2014 Francis
2014/0239594 A1 8/2014 Deloatch
2014/0315667 A1 10/2014 Manner et al.
2014/0333026 A1 11/2014 Hynds
2014/0333028 A2 11/2014 Nally
2014/0367915 A1 12/2014 Poulos
2015/0054221 A1 2/2015 Sandman et al.
2015/0108719 A1 4/2015 Devine
2015/0115532 A1 4/2015 Martinson et al.

FOREIGN PATENT DOCUMENTS

GB 2338905 A 1/2000
GB 2338905 B 10/2002
WO 1991019546 A1 12/1991
WO 2009025853 A1 2/2009
WO 2009094823 A1 8/2009
WO 2012017249 A1 2/2012
WO 2012079211 A1 6/2012
WO 2012158373 A2 11/2012
WO 2014004803 A1 1/2014
WO 2015063443 A1 5/2015

* cited by examiner

ANIMATED TARGET GAME

This application claims priority to, and the benefit of, U.S. Provisional Patent Application No. 62/250,148 filed on Nov. 3, 2015 with the United States Patent Office, which is hereby incorporated by reference.

BACKGROUND

This invention relates in general to target games and methods for animating a target game and playing an animated target game. More particularly, this invention relates to a target game with an animated target and methods for animating a target.

SUMMARY

In the present invention, a game structure with an animated component comprises a target structure having a first target surface and a second target surface. In some embodiments, the first target surface is separated from the second target surface by a joint. An animation mechanism is provided for moveably connecting the first target surface to the second target surface at the joint.

In various embodiments, the animation mechanism comprises one or more flexible strips connected to the first target surface and connected to the second target surface. The one or more flexible strips extend across the joint. The animation mechanism further comprises a stabilizing arm. The stabilizing arm is secured to the first target surface at a fixed connection at a first end of the stabilizing arm. To a second end of the stabilizing arm is a spring mechanism securing the second target surface to the second end of the stabilizing arm.

In the present invention the target structure animates when hit by a projectile propelled at and/or contacting the target structure. In various embodiments the projectile is propelled at the target structure in order to hit an image on the target structure. To offset the energy exerted on the game, a ballast may be provided at a base of the target structure. In some embodiments, this ballast may double as a storage compartment. In some embodiments, the target structure comprises an image of a moving object. The joint may be positioned at one or more moving parts of the image of the moving object. Some embodiments may further comprise one or more apertures formed in the target structure for receiving a projectile propelled at the target structure. The one or more apertures may be positioned at one or more moving parts of the image of the moving object. To increase the difficulty of the game, a deflecting panel may be attached to the target structure and may be positioned in at least one or more apertures. Further, the deflecting panel may be moveably attached to the target structure.

In some embodiments, the game structure may further comprise a stand for supporting the target structure in a generally upright position. The stand may be of a tripod configuration. In variations of these embodiments, the stand may be retractable into the target structure for transport. Similarly, the game structure may be configured into a transport position. To this end, the first target surface may fold over the second target surface at the void into the transport position. A carrying structure may also be attached to the target structure to further aid in transport.

A method for animating a game structure is also provided herein. The method includes providing a target structure. Dividing the target structure into a first target surface and a second target surface at a joint. Moveably connecting the first target surface to the second target surface with an animation mechanism at the joint, the animation mechanism comprising one or more flexible strips, the one or more flexible strips being connected to the first target surface and being connected to the second target surface wherein the one or more flexible strips extend across the joint. Stabilizing the first target surface to the second target surface with a stabilizing arm wherein the stabilizing arm is secured to the first target surface by a fixed connection at a first end of the stabilizing arm and the stabilizing arm is secured to the second target surface at a second end of the stabilizing arm by a spring mechanism. Striking the first target surface or the second target surface to generate movement between the first target surface and the second target surface and initiate a recoil in the spring mechanism.

The foregoing and other objects, features and advantages of the invention will be apparent from the following more detailed descriptions of embodiments of the invention, as illustrated in the accompanying drawings wherein like reference numbers represent like parts of the invention.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
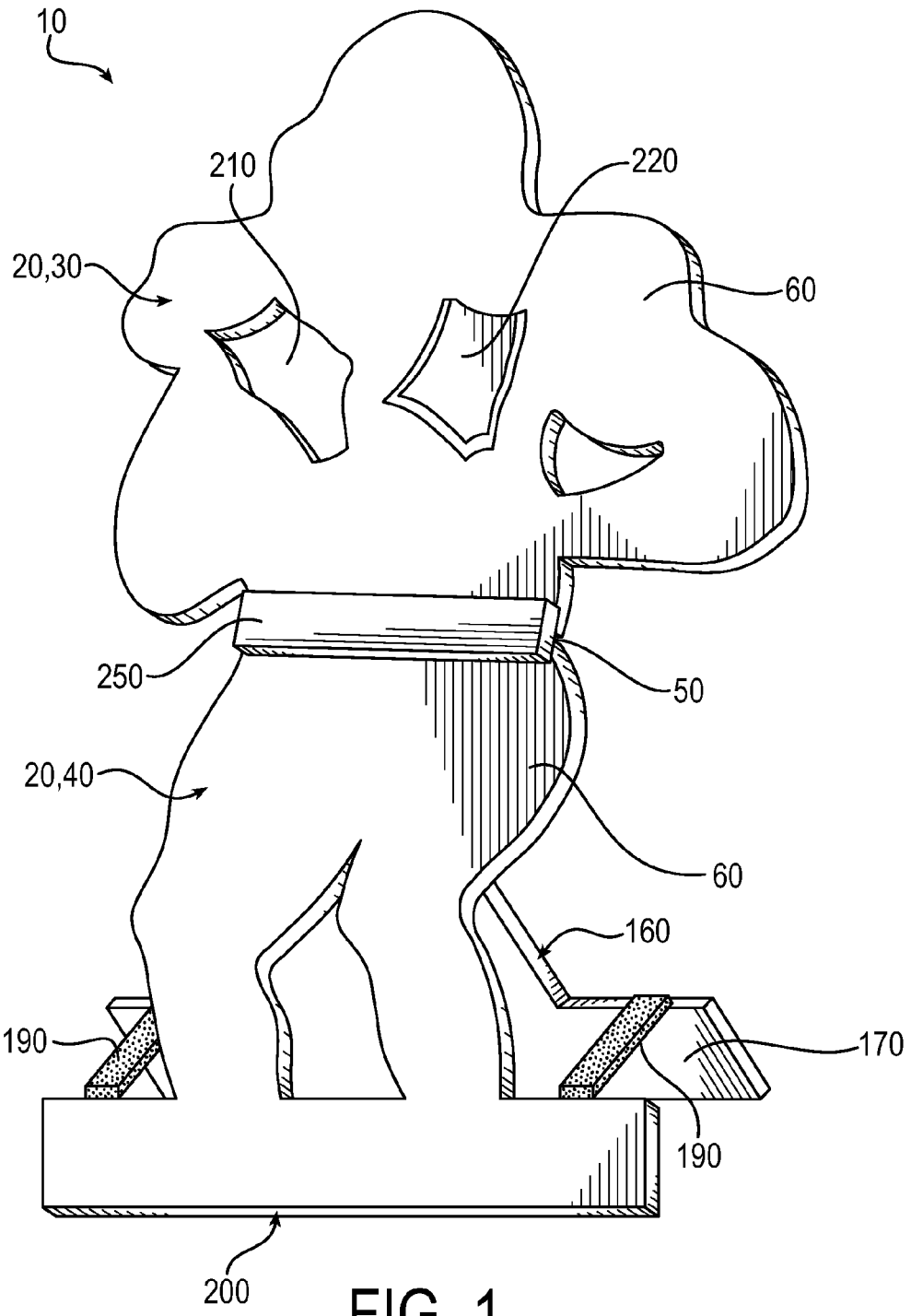
FIG. 1 is a perspective view of an animated target game from the front surface of the target structure, in accordance with an embodiment of the invention.

An animated target game with a game structure includes a game target structure that moves to enhance a game participant's or observer's experience. In various embodiments, the game target structure of the animated target game provides movement at positions on the game surface which correspond to moving components of a moving object, the game surface providing an image of the respective object. The moving object may be a living creature or a machine, including an athlete, animal, vehicle or the like. Alternatively, the moving object may be an imaginary creature or object, including a monster, futuristic machine or the like.

In some embodiments of the present invention, the animated target game comprises a target structure. The target structure may be positioned in an upright position, vertical position or any position there between, based upon the user's preferences. The target structure may be a flat surface for receiving an image of the moving object. The image may be painted directly onto the target structure, applied as a covering made independently of the target structure, or simply a photo attached to the target structure. Means for attachment of the image to the target structure may include permanent means such as adhesive, mechanical connections, etc. and removable means such as VELCRO®, static connection, magnetic connection, etc. The perimeter of the target structure may additionally correspond to the perimeter of the image of the moving object. The image may be provided as a detailed profile, such as a high definition photo of the object, may be a silhouette of the object, or any other variation of the object.

In alternative embodiments, the target structure may include contours or protrusions. The contours or protrusions may be configured to provide obstacles to the gaming experience. Further, the contours or protrusions may correspond to three-dimensional contours or protrusions of the object reflected in the image of the moving object. By example, a three dimensional image of a person or athlete may be reflected in the image by providing contours at body features such as shoulders, chest, nose, etc. These contours may be provided to further deflect or even guide a projectile to or from a scoring feature at the target structure.

The target structure may further comprise a plurality of target surfaces. By example, a first target surface of the plurality of target surfaces may be moveably connected to a second target surface. A mechanism for moveably connecting target surfaces will be discussed in greater detail below. In some embodiments, a joint divides the first target surface from the second target surface. In particular embodiments, the joint is positioned at a point of movement of the object reflected in the image of the moving object. Examples of a point of movement of the object reflected in the image of the moving object include a waist, a shoulder, a knee, an elbow, a neck etc. of a person or animal and a tire, a suspension, a door, etc. of a vehicle. Other animated objects or machines may comprise additional points of movement and these points of movement are not limited by the lists provided above. In variations of these embodiments, multiple joints may be provided at numerous locations of the target structure thereby providing more than a first target surface and a second target surface.

In some embodiments, the target game is animated by moving the second target surface in relation to the first target surface. An animation mechanism for this movement may include a hinge, a spring, a string, an artificial elastomer, a pivot point, a ball and hitch, a threaded connection and/or a combination thereof. The first target surface and the second target surface may be directly connected to one another by providing a joint comprising perforations or comprising flexible and/or thinner material. Alternatively, the first target surface and the second target surface may be moveably connected to one another including being separable or having separation between the first target surface and the second target surface at the joint with an animation mechanism connecting the first target surface to the second target surface. To hide the joint, a skirt may be added to conceal the joint to one side and/or the other side of each target surface. A skirt may be made of flexible material that moves with the movement at the joint, as discussed in greater detail below. Although an animated feature, as described above, includes animation provided at a joint between multiple target surfaces it is also appreciated a single rigid target structure may be provided and the animation may be provided at other components of the structure, such as the one or more apertures as discussed in great detail below. It is also appreciated that the animation may be provided by a combination of the moving structural components as discussed herein.

In one particular embodiment and as illustrated in the figures, the animation mechanism includes a combination of one or more flexible rubber strips, a stabilizing arm, and a spring. In this embodiment, the first target surface and the second target surface are separated by the joint. Connecting the first target surface to the second target surface are one or more flexible rubber strips secured to the first target surface and the second target surface and extending from the first target surface to the second target surface. In various embodiments, the flexible target rubber strips are secured to a back surface which is to the opposite side of the front surface comprising the image of the moving object. It is understood, the flexible rubber strips may be attached to any surface of the target structure. The flexible rubber strips may be connected to each target surface by any mechanical means known in the art, examples of which include bolts, screws, staples, nails, adhesives, and/or the like. The flexible rubber strips provides flexibility between the first target surface and the second target surface.

In some embodiments, the movement between the first target surface and the second target surface is further controlled by the stabilizing arm. The stabilizing arm may limit the range of motion between the first target surface and the second target surface or amplify the motion between the first target surface and the second target surface, or a combination thereof. In an embodiment, the stabilizing arm extends from the first target surface to the second target surface. In this embodiment, the stabilizing arm is secured with the first target surface such that it moves with or relative to the first target surface at a fixed connection located to the first end of the stabilizing arm. The stabilizing arm may be secured directly to the target structure, to the one or more flexible rubber strips, or to a spacer positioned between the stabilizing arm and the target structure and/or the one or more flexible rubber strips. Any mechanical means known in the art, examples of which are provided above, may be used to attach the stabilizing arm to these features.

The stabilizing arm extends from the fixed connection at the first end of the stabilizing arm across the joint to the second target surface at a second end of the stabilizing arm. Between the second target surface and the second end of the stabilizing arm is a spring structure. The spring structure may be any mechanical device that stores mechanical energy. Examples of a spring structure include a coil spring, a compressible medium, a polymer, a hydraulic mechanism, a pneumatic mechanism, or the like. The spring structure may be further attached to the second target surface. When the first target surface moves in relation to the second target surface, the stabilizing arm moves with or relative to the first target surface at the fixed connection or the first end of the stabilizing arm. Therefore, the stabilizing arm moves independent of the second target surface at the second end of the stabilizing arm. This independent movement uses mechanical energy stored at the spring structure, which is attached to the second end of the stabilizing arm, to force the first target surface to move back and forth in relation to the second target surface at the joint. In other words, recoil is generated at the spring structure moving the spring structure, and one or more components attached thereto, back and forth. By example, when using a coiled spring which is attached to the second end of the stabilizing arm at one end and attached to the second target surface at the opposite end, the coiled spring expands and contracts, thereby, pulling and pushing, respectively, the stabilizing arm to and from the second target surface until energy dissipates. Thereby, the coiled spring uses energy exerted on the first target surface, when the game is in play or when projectiles contact the target structure (discussed in greater detail below), and uses this energy to move the first target surface relative the second target surface at the joint.

In some embodiments wherein the target structure is in a generally upright position, between a horizontal and a vertical position, the first target surface may be positioned above the second target surface which is further positioned on a base in contact with the ground or a floor. In these embodiments, when the first target surface is secured to the second target surface using one or more flexible rubber strips, the stabilizing arm further supports the first target surface above the second target surface. This is achieved, such as the embodiment discussed above, by securing the spring structure to both the stabilizing arm, which is additionally secured to the first target surface, and the second target surface. Thereby, the first target surface is maintained upright above the second target surface within a range limited by the spring structure's movement between the second target surface and the stabilizing arm.

In various embodiments, the first target surface may collapse over the second target surface in order reduce or compress the target game for transport in a transport position. This may be accomplished by folding the first target surface over the second target surface at the joint. In one embodiment, the flexible rubber strips allow the front surface of the first target surface to fold and face the front surface of the second target surface when the flexible rubber strip is attached to each back surface, respectively. In embodiments comprising the stabilizing arm, the stabilizing arm may be removably secured to the back of the first target surface or the second target surface. The stabilizing arm may be removably secured from the spring structure and/or the spring structure attached to the stabilizing arm may be removably secured from the second target surface. In the instance of using a coiled spring, a single coil of the spring may be removably secured by fastening the single coil of the spring to the second target surface by any mechanical means, such as securing the single coil between a plate and the target structure and/or a plate and the stabilizing arm such that the single coil may be slid from behind the plate. When in an upright position for game play, the coil spring may be locked in behind the plate using a securing mechanism such as a hook, lock, clip or the like. Further, when the target game is in a transport position, the stabilizing arm may be rotatably connected to the first target surface at the fixed connection. Therefore, when the first target surface is folded over the second target surface, the stabilizing arm may be rotated about the fixed connection to position the stabilizing arm entirely or substantially adjacent the first target surface.

To further assist in moving the target game when the target game is in the transport position, the target game may include a carrying structure. The carrying structure may comprise a shoulder harness, shoulder strap, handle or the like. The carrying structure may be secured to the target structure, including the first target surface and/or the second target surface, in order to hoist the target game onto the shoulder of the individual carrying the game or a transport structure for moving the game. The carrying structure may be secured to the target structure using any mechanical means known in the art and/or adhesive. The transport structure for moving the game may include hooks or hangers for supporting one or more target games on a single carrying structure.

In various embodiments, the target game may be supported by a stand in a generally upright position. The stand may support the target structure on a ground surface, a floor surface, an elevated structure, etc. Further, the stand may elevate the target structure from the ground surface, the floor surface, or the elevated structure. In some embodiments, a support structure may extend from the target structure in a tripod position and may be collapsible into a transport position, or against a surface of the target structure. Thereby, the support structure may be attached to the target structure by a hinge and/or any mechanical means known in the art to support the structure in the tripod position. Alternatively, the target game may be suspended from a structure positioned above, to the side and/or from behind the target game.

Various embodiments of the present invention may further include a ballast. The ballast may be secured to the base of the target game to provide support to the game structure. The ballast stabilizes the target game when the mechanism for moveably connecting the plurality of target surfaces is in use and to maintain the energy for the mechanism for moveably connecting the plurality of target surfaces at the one or more spring structures without upsetting or tipping the target game. The ballast comprises weights or may be filled with weights for this purpose. The ballast may be positioned on the support structure and/or to a bottom of the target structure. In variations of these embodiments, the ballast may additionally serve as a storage compartment for the projectiles, a storage compartment for beverages and/or ice (such as a cooler) and/or a storage compartment for other products. The contents of each storage compartment may function as the weights or in combination with the weights.

The present invention may also contain a bin for collecting or storing the projectiles. The bin may be attached to or positioned near the target surface and/or the stand. More than one bin may be provided at the target game. By example, one or more bins may be provided at each aperture or each target surface. In one particular embodiment, a bin is located near the base of the target game. The bin may include an opening at the top of the bin. The opening may be used for simply placing and storing the projectiles or other parts of the game structure. The bin may also be used for catching projectiles as they slide down the target surface. In some embodiments, the bin may be used to capture projectiles and provide a way to score points when playing the target game. In various embodiments, the bin may double as a ballast as described above.

In some embodiments, the present invention may include one or more apertures in the target structure configured to receive a projectile propelled toward the target structure. The one or more apertures may correspond to a characteristic illustrated on the image of the moving object. By example, the one or more apertures may correspond to a hand, a mouth, a joint on a body, windows on a vehicle, and/or equipment worn by a person or animal, etc. for receiving or catching a projectile. The aperture may additionally serve an additional or alternative purpose, such as a bottom opener for opening a bottle, an access point for reaching contents of the storage compartment, etc.

To increase the difficulty of the play of the target game, deflecting panels may be provided by or near at least one of the one or more apertures. The deflecting panel may be secured to the front surface of the target structure, the back surface of the target structure and/or within the aperture. The deflecting panel may be movably secured such that the projectile is propelled into an aperture and may force the deflecting panel to move within the aperture thereby allowing the projectile to pass through the aperture. In the alternative, if a projectile is not propelled with enough force, the deflecting panel may prevent the projectile from passing through the aperture. The deflecting panels may be made of rigid materials attached to the target structure by a hinge. Alternatively, the deflecting panel may be made of flexible material which flexes under the force of the propelled projectile. Other examples of a deflecting panel include paper or other penetrable material secured at the aperture and torn by the projectile propelled through the aperture, a balloon which may burst under the force exerted by the projectile propelled through the aperture, etc.

In some embodiments a cover panel may be provided to conceal the animation mechanism. Further, the cover panel may also cover the one or more apertures formed in the target structure. The cover panel may be rigid or flexible or a combination thereof. The cover panel may take the shape of the image of the target structure, thereby creating a three-dimensional image. In various embodiments, the cover panel may also perform as or be the deflecting panel, as described above. In these embodiments, the cover panel extends across the back surface of the target structure at the location of one or more apertures. When a projectile contacts the deflecting panel, the force of the contact may result in the projectile bouncing out of the one or more apertures. The cover panel may be secured, attached or adhered to the target structure at the perimeter or at any location on the target structures. In some embodiments, the cover panel may be secured, attached or adhered to the target structure at or near one or more apertures to increase the resistance when contacted by a projectile at that respective aperture. Multiple cover panels may be provided at one or more apertures, one or more animation mechanisms, at the stand, the bin, the carrying structure, the ballast, and/or the like. In various embodiments, the cover panels may include secondary apertures for additional scoring opportunities. Cover panels may also be provided at the stand, the bin, the carrying structure, the ballast, and/or the like. The cover panel may be removable in order to access the animation mechanism, the stand, the bin, the carrying structure, the ballast, and/or the like. In some embodiments, the cover panel may guide the projectiles to the bin.

A method for playing the animated target game includes propelling a projectile toward the target structure and/or the one or more apertures in the target structure. Examples of a projectile that may be used to play the animated target game include a bag, a ball, a bullet, an arrow, a dart, a disc, a container, garbage, a toy, a bottle, a can or any other object known to be used in target or target games. In some embodiments, a player of the target game will stand a predetermined distance from the target game and propel the projectile toward the target structure. When the projectile contacts or strikes the target structure, movement at the joint is initiated and maintained by the mechanism for moveably connecting the plurality of target surfaces. Energy from the initial contact or strike is used by the spring mechanism to force the first target surface to continue to move back and forth in relation to the second target surface. This movement animates the target game and gives the impression of giving movement to the image of the moving object or animating the image of the moving object, thereby adding a new level of excitement.

In some embodiments, a method for playing an animated target game includes a team or player on an offense position and/or a team or player on a defense position. A team is a plurality of players. A game of odds may be used to determine which team or player will begin on the offense position or the defense position. Examples of a game of odds includes flipping a coin, rolling a die or dice, or the like. Once the initial positions are determined, each team or player locates themselves on a playing surface with the projectiles. The playing surface may be defined by having a team or player position themselves a predetermined distance from the target structure. The playing surface may also be defined by a predetermined distance between two or more target structures. The target structures may further face one another.

In one particular embodiment, a throwing mat may be placed between the team or player and the target structure and/or between the two or more target structures to establish the predetermined distance. The throwing mat may be carpet, a board, markers, rope, paper, markings on the ground, or the like. The throwing mat may be placed flat on the ground surface. Facing up on the throwing mat may be advancing indicators. By example, the advancing indicators may be representative of yardage lines on a football field, positions on a hockey court, plates on a baseball diamond, or the like. Each advancing indicator indicates a points value and/or advancing value which is awarded if a projectile successfully strikes the target structure and/or passes through an aperture in the target structure. In contrast, the defense position may also throw a projectile at the same target structure and/or another target structure after each offensive throw, or alternate in a predetermined order with the offense position. In some embodiments, the defense position may toss from the same throwing location as the offense position. In the instance the defense position completes a comparable or same throw as the offense position, the points value and/or advancing value awarded the offense position is offset or stopped. If the defense position completes a throw of lesser value than the offense position, a fraction or a portion, such as half the value, of the points value and/or advancing value awarded to the offense position may be offset.

In one particular embodiment of the present invention, an example of a method for playing a game is described in comparison to the game of football. In this particular embodiment, the method of playing the game consists of a player mock-up piece. The player mock-up piece is a score board which illustrates the various positions available for the various positions of play. By example, a player mock-up board may be representative of a scoreboard used at a football game. The score board allows each team or player to keep track of their position and score in the game. This particular embodiment also includes a throwing mat. The throwing mat indicates the different throwing distances and/or the advancing indicators available for each player or team. By example, the throwing mat may be representative of a football field, including the distance markers and end zones of a football field. The throwing mat allows the players or teams to keep track of their respective advancing positions in the game. To mark the advancing positions, an offensive marker and/or a defensive marker may be used to indicate each offense position and/or each defense position, respectively. The offense marker and/or the defense marker is placed or marked on the throwing mat. In this particular embodiment, eight projectiles may be provided. Four projectiles are available to the player or team on the offense position and four projectiles are available to the player or team on the defense position. It is, however, contemplated that more or less projectiles may be used for the offense and/or defense position.

To play the method of playing the game of the example of this particular embodiment, once the offense and defense positions are determined each player or team on the offense position or the defense position will take their projectiles and position themselves on the starting position of the throwing mat. For each toss of a projectile at the target structure, a faux throwing distance or a faux running distance is determined for advancing on the throwing mat. As indicated above, the defense may also make a toss of a projectile at the target structure to offset the advancing position of the offense position. In the example of a football field, by tossing the projectile the offense position may progress through advancing markers representative of yardage lines on a football field and into the respective end zone. In one particular embodiment, the throwing mat may be ten feet. In another embodiment, the throwing mat may be 20 feet. Advancing positions may be representative of a running play and/or a passing play in a football game with apertures designated for both or either with a predetermined awarded advancing quantity (i.e. advancing yardage on a football field). If the tossed projectile misses the hole then the play is incomplete or has no gain. The offense position may be limited to four downs on each turn, similar to four downs in a football game. The offense position moves through advancing positions until a touchdown is scored. Additional tosses of the projectile may be made for extra point attempts. The defense position may toss a projectile at a target structure after each offense position toss of a projectile. The defense position may offset or stop the offense position advancement through the advancing positions.

Embodiments of the animated target game discussed above will now be described in further detail below in association with the figures filed herewith exemplifying the present invention in association with these embodiments.

Figure 2:
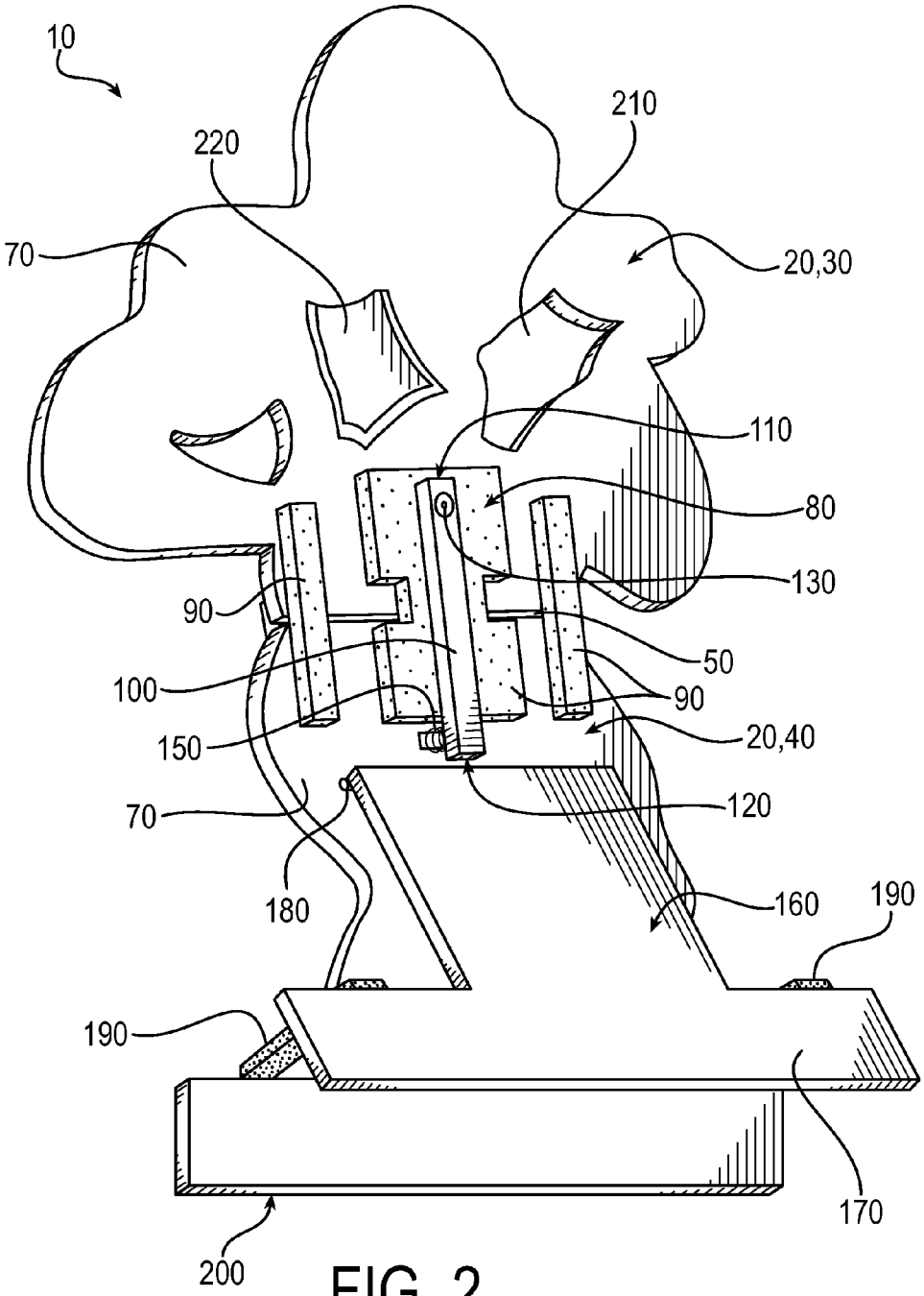
FIG. 2 is a perspective view of an animated target game from the back surface of the target structure, in accordance with an embodiment of the invention.
Figure 3:
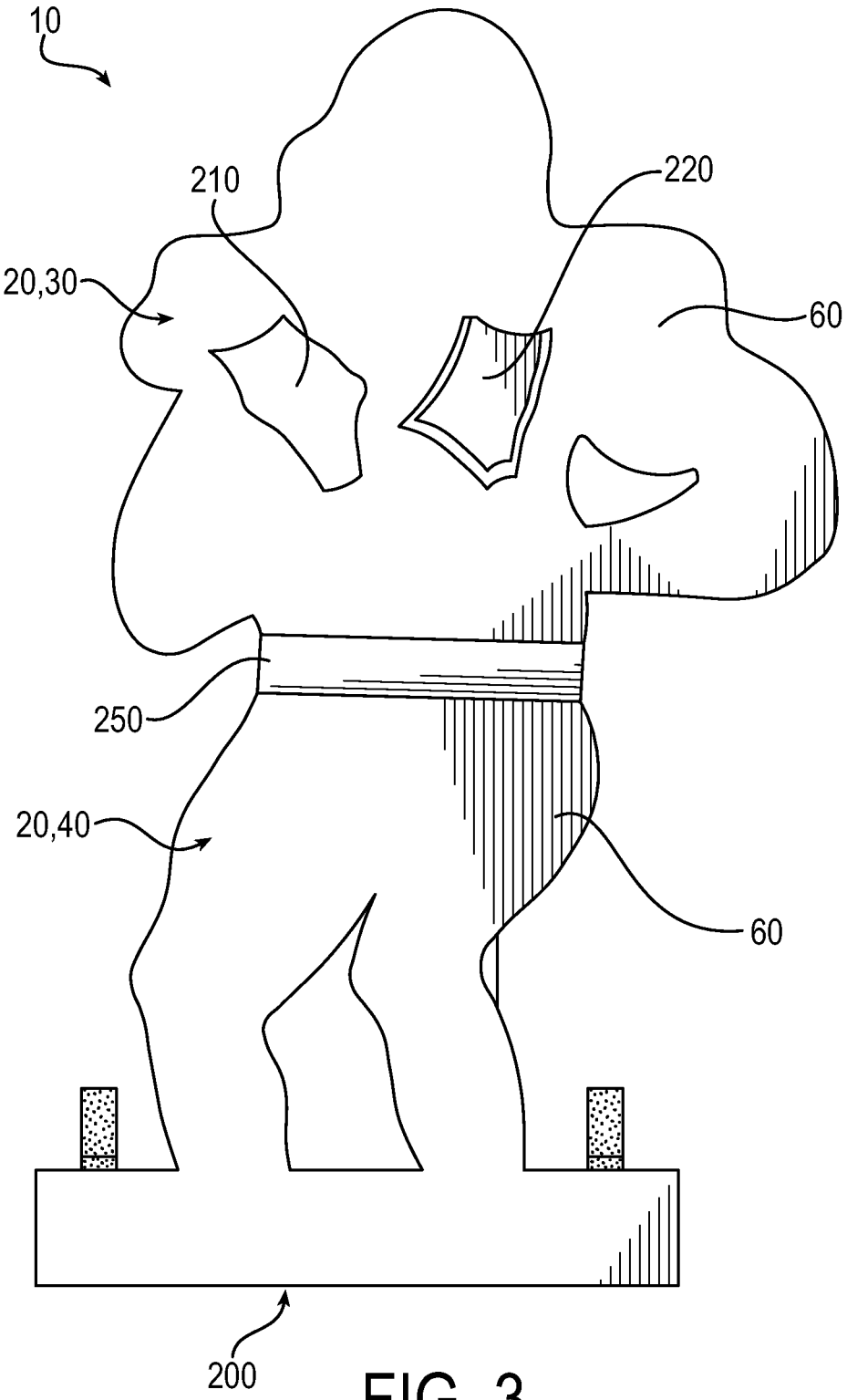
FIG. 3 is a front view of an animated target game from the front surface of the target structure, in accordance with an embodiment of the invention.

With reference to FIG. 1 and FIG. 3, in an embodiment of a target game 10 a target structure 20 includes a first target surface 30 and a second target surface 40. Separating the first target surface 30 from the second target surface 40 is a joint 50. The first target surface 30 and the second target surface 40 additionally have a front surface 60 and a back surface 70 (as illustrated in FIG. 2). On the front surface 60 the joint is concealed by a skirt 250. In some embodiments a player will propel one or more projectiles toward an image depicted on the front surface 60.

Figure 4:
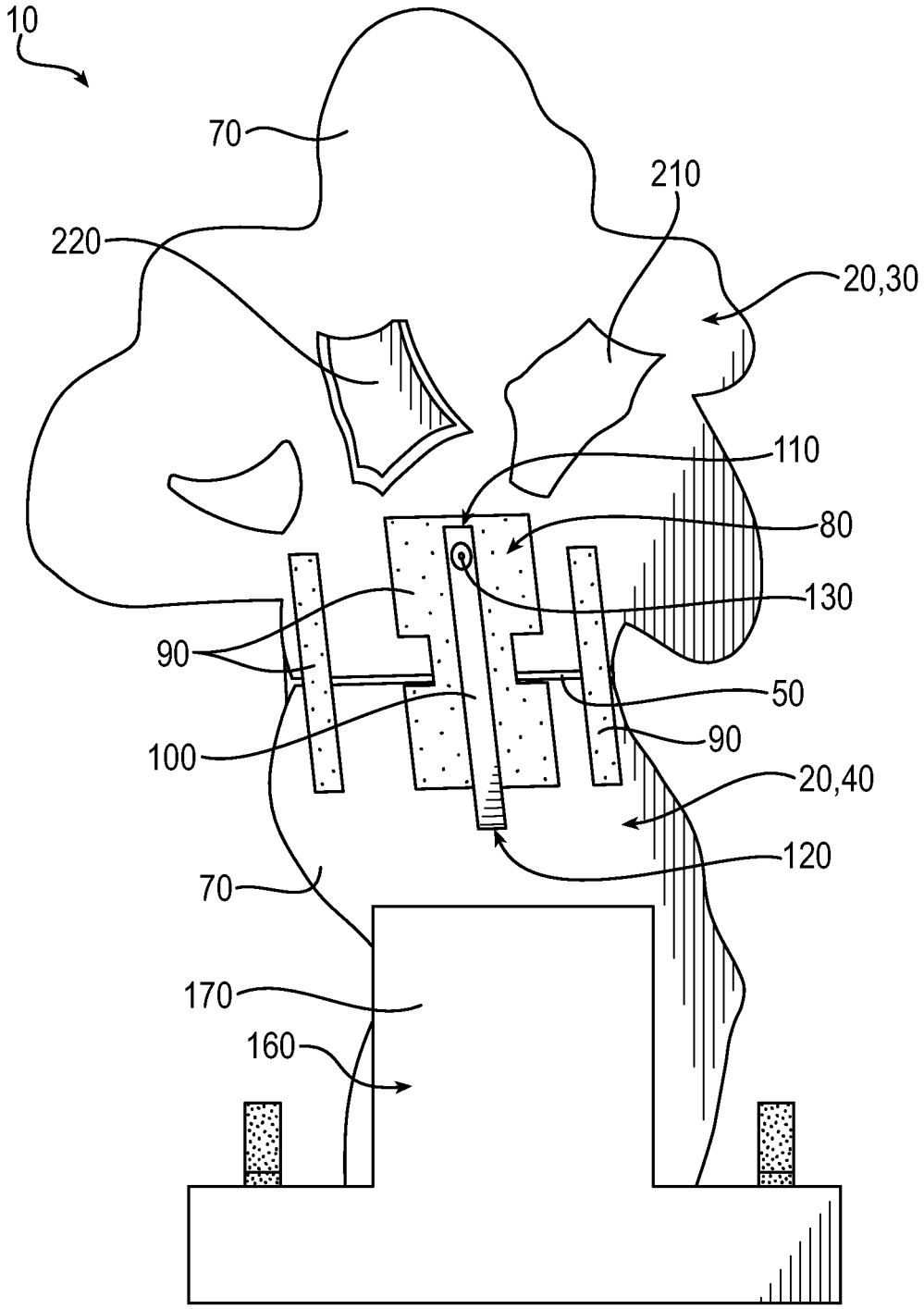
FIG. 4 is a back view of an animated target game from the back surface of the target structure, in accordance with an embodiment of the invention.

Turning to FIG. 2 and FIG. 4, an animation mechanism 80 is attached to the back surface 70 and extends from the first target surface 30 across the joint 50 to the second target surface 40. The animation mechanism 80 movably connects the first target surface 30 to the second target surface 40. In FIG. 2, the animation mechanism 80 comprises one or more flexible strips 90. The flexible strips 90 are secured to the back surface 70 of the first target surface 30 and the second target surface 40 and provide for movement at the joint 50. The animation mechanism 80 further comprises a stabilizing arm 100. The stabilizing arm 100 is secured to the first target surface 30 at a fixed connection 130. The fixed connection 130 is positioned to the first end 110 of the stabilizing arm 100. In FIG. 2 the stabilizing arm 100 is secured to one of the one or more flexible strips 90 which is further secured to the first target surface 30. A spacer may additionally be provided between the stabilizing arm 100 and the flexible strip 90 and/or the stabilizing arm 100 and the first target surface 30 to increase the distance between the stabilizing arm and the target structure, thereby increasing the range of movement. Opposite the first end 110 of the stabilizing arm 100 is a second end 120. Attached to the second end 120 of the stabilizing arm 100 is a spring mechanism 140. The spring mechanism 140 comprises a coil spring 150 with one end secured to the stabilizing arm 100 and an opposite end of the helical configuration secured to the back surface 70 of the second target surface 40. The coil spring 150 uses the energy from force exerted on the first target surface 30 to continue to move the first target surface 30 in relation to the second target surface 40.

Still referring to FIG. 2, the target game 10 further comprises a stand 160 for supporting the target structure 20 in a generally upright position. The stand 160 of FIG. 2 comprises a support panel 170 attached to the back surface 70 of the second target surface 40. As further illustrated by FIGS. 5-7, the support panel 170 is movably attached by a hinge 180 to the back surface 70 of the second target surface 40. The support panel 170 is additionally secured by one or more straps 190 to keep the support panel 170 from extending too far from the second target surface 40 at the base 200.

As illustrated by FIGS. 1-4, some embodiments of the target game 10 may further comprise one or more apertures 210. The apertures 210 extend through the target structure. A net or container may be further provided to capture or catch any projectiles passing through the apertures 210. Further, a passageway may be provided from each aperture to a single container provided at or near the target game 10. As discussed above, deflecting panels 220 may be further provided at each aperture 210.

Figure 5:
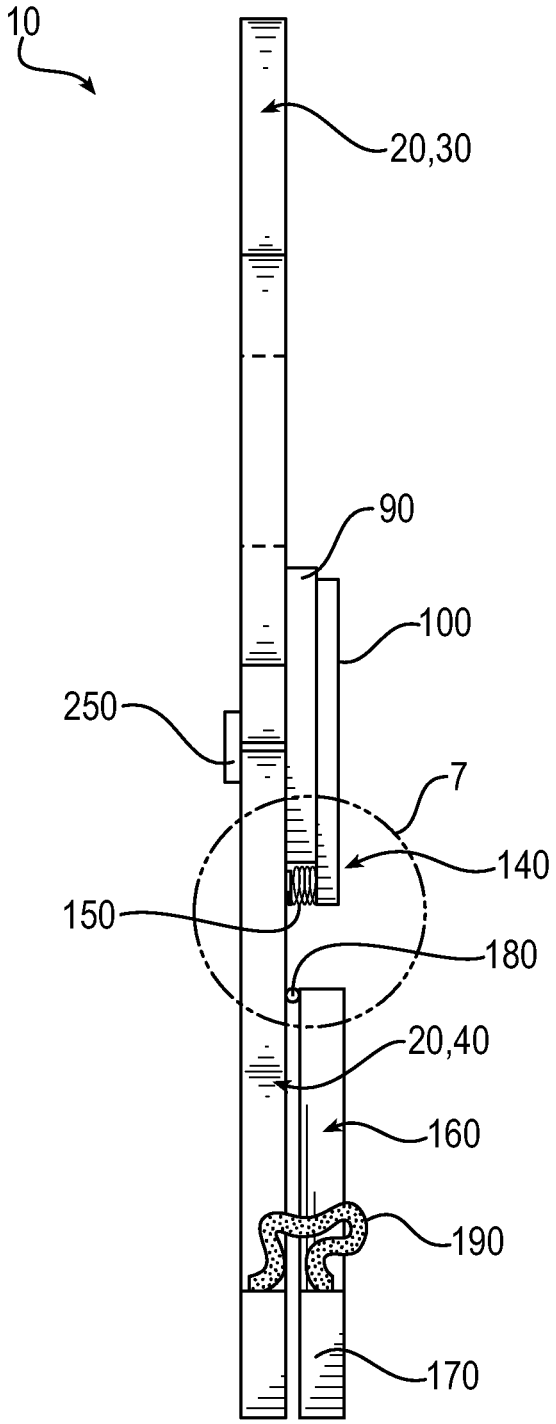
FIG. 5 is a side view of an animated target game with the stand retracted, in accordance with an embodiment of the invention.
Figure 6:
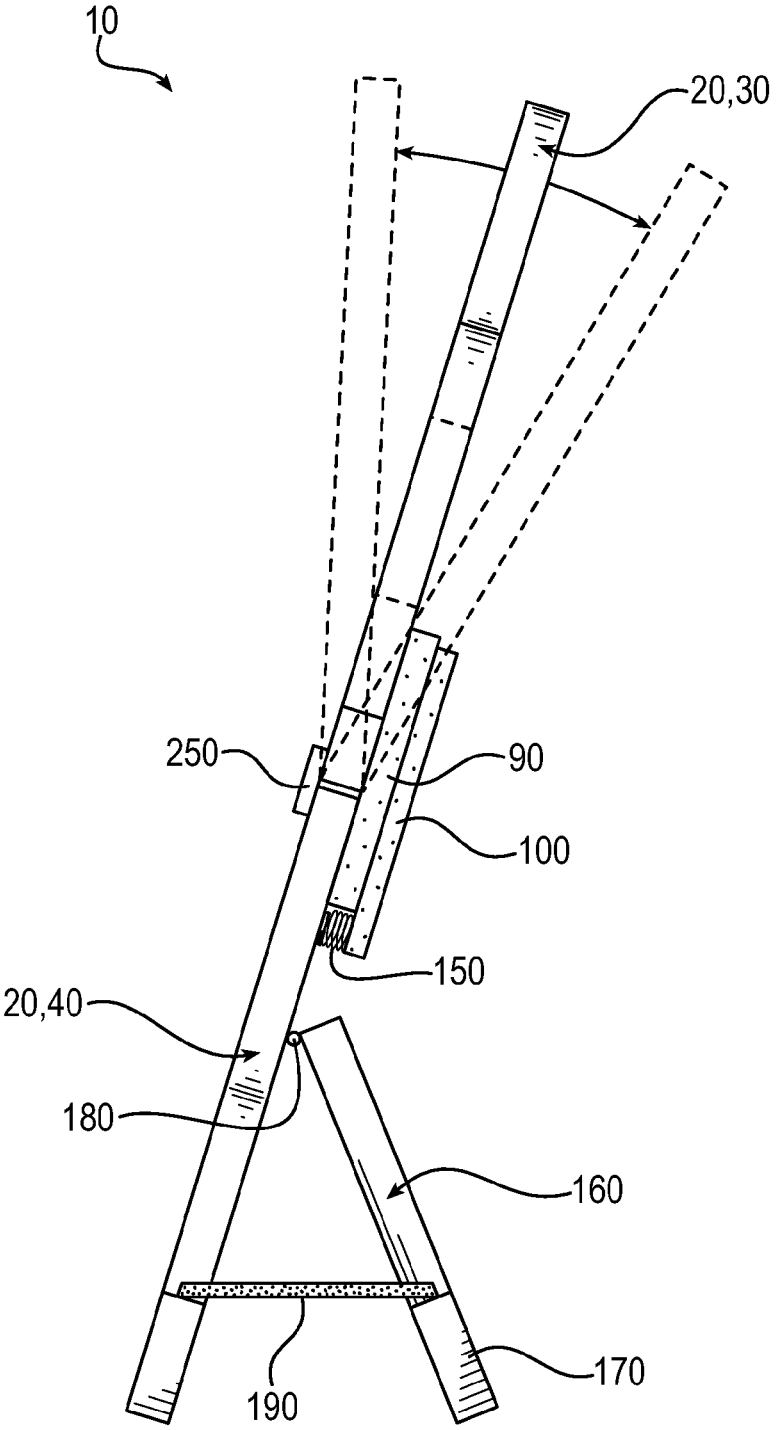
FIG. 6 is a side view of an animated target game with the stand expanded and illustrating the animation of the animated target game, in accordance with an embodiment of the invention.
Figure 7:
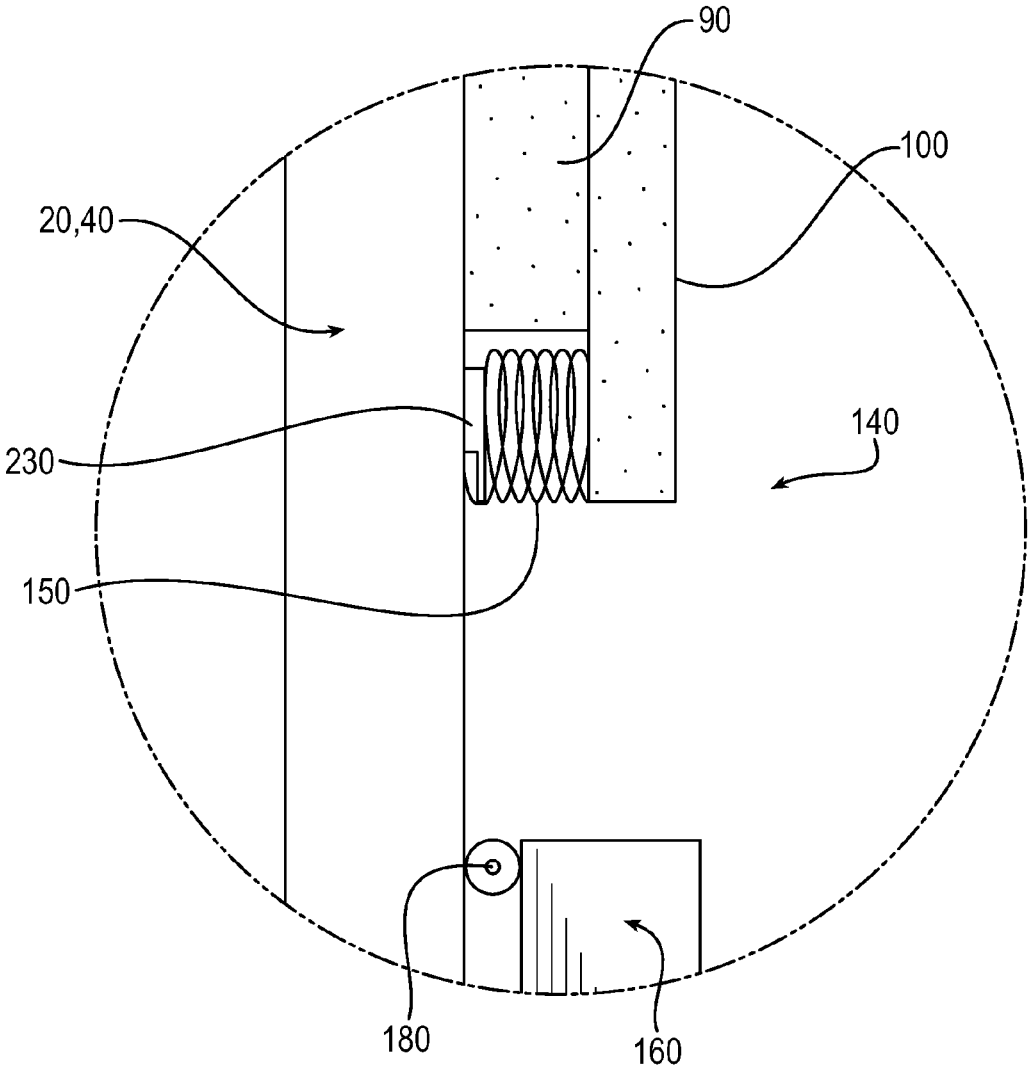
FIG. 7 is a partial view of a spring structure of the animated target game at 7 of FIG. 5, in accordance with an embodiment of the invention.

Turning to FIG. 5, a side view of the target game 10 is illustrated with the stand 160 retracted into the target structure 20. FIG. 6 further illustrates a side view of the target game 10 with the stand 160 in use and the range of movement of the first target surface 30 in relation to the second target surface at the animation mechanism 80. FIG. 7 is a detailed view of the spring mechanism 140 of the animation mechanism 80. In particular, the spring mechanism 140 of FIG. 7 includes a coil spring 150 which is attached to the second end 120 of the stabilizing arm 100. A plate 230 is secured to the back surface 70 of the second target surface 40. The coil spring 150 is removable secured to the second target surface 40 by the plate 230.

Figure 8:
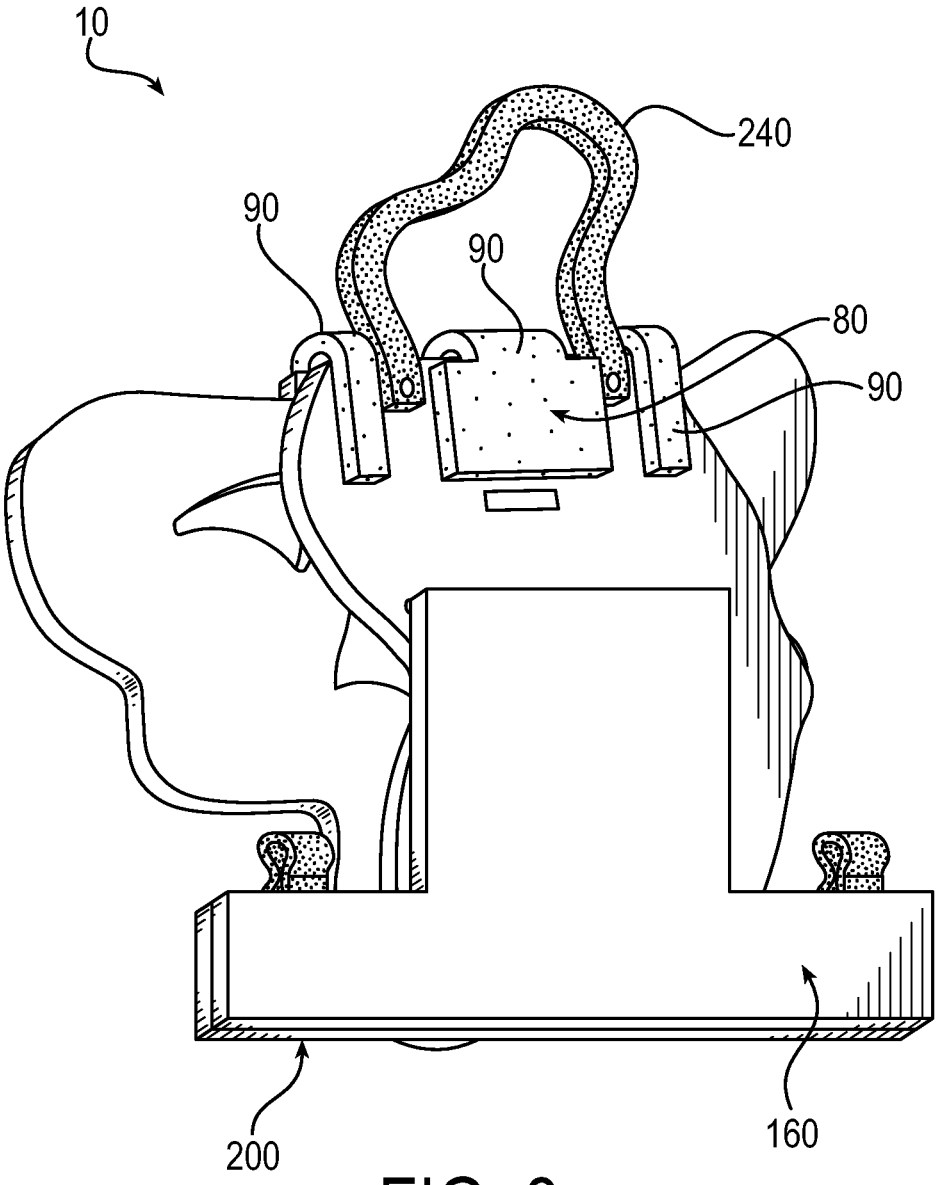
FIG. 8 is a perspective view of an animated target game in a transport position, in accordance with an embodiment of the invention.
Figure 9:
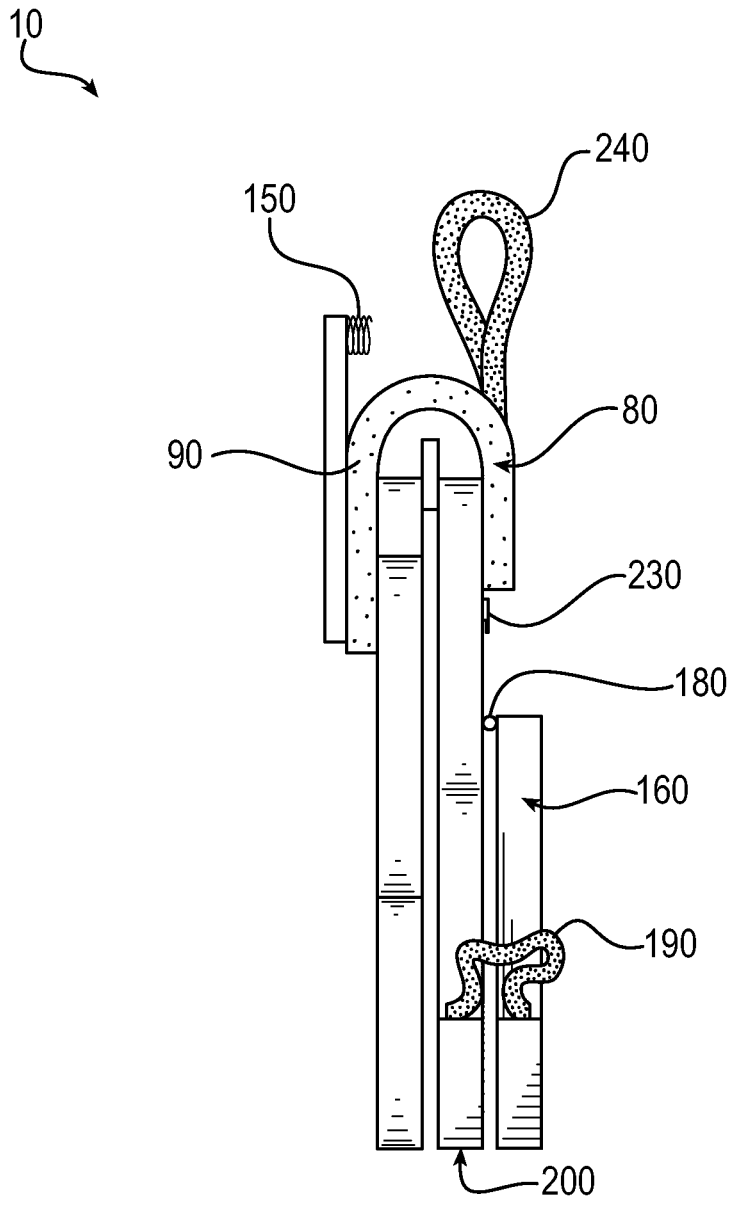
FIG. 9 is a side view of an animated target game in a transport position, in accordance with an embodiment of the invention.

FIGS. 8 and 9 show the target game 10 in a transport position. As illustrated, the front surface 60 of the first target surface 30 folds over, at the animation mechanism 80, to face the front surface 60 of the second target surface 40. Similarly, the stand 160 retracts toward the back surface 70 of the second target surface 40. The target game 10 may further include a carrying structure 240 secured to the target structure 20 for lifting and transporting the target game 10. Further, the stabilizing arm 100 is shown to rotate at the fixed connection 130 such that the stabilizing arm 100 is substantially positioned over the first target surface 30 for transportation.

The terms "comprising," "including," and "having," as used in the claims and specification herein, shall be considered as indicating an open group that may include other elements not specified. The terms "a," "an," and the singular form of words shall be taken to include the plural form of the same words, such that the terms mean that one or more of something is provided. The terms "at least one" and "one or more" are used interchangeably. The term "single" shall be used to indicate that one and only one of something is intended. Similarly, other specific integer values, such as "two," are used when a specific number of things are intended. The terms "preferably," "preferred," "prefer," "optionally," "may," and similar terms are used to indicate that an item, condition or step being referred to is an optional (i.e., not required) feature of the invention.

While this invention has been described with reference to particular embodiments thereof, it shall be understood that such description is by way of illustration only and should not be construed as limiting the scope of the claimed invention. Accordingly, the scope and content of the invention are to be defined only by the terms of the following claims. Furthermore, it is understood that the features of any specific embodiment discussed herein may be combined with one or more features of any one or more embodiments otherwise discussed or contemplated herein unless otherwise stated.

What is claimed is:

1. A game structure comprising:

a target structure having a first target surface and a second target surface, the first target surface and the second target surface each having a similarly oriented front surface and a similarly oriented back surface where the front surfaces are positioned on opposite sides of the target structure as the back surfaces, and wherein the first target surface is separated from the second target surface by a joint;

an animation mechanism for moveably connecting the first target surface in relation to the second target surface at the joint, the animation mechanism comprising one or more flexible strips, the one or more flexible strips connected to the back surface of the first target surface and connected to the back surface of the second target surface wherein the one or more flexible strips extend across the joint, the animation mechanism further comprising a stabilizing arm wherein the stabilizing arm is secured to the back surface of the first target surface by a fixed connection at a first end of the stabilizing arm and wherein the stabilizing arm is secured to the back surface of the second target surface at a second end of the stabilizing arm by a spring mechanism, and wherein the animation mechanism is concealed and separated from the front surfaces of the first and second target surfaces by the back surfaces of the first and second target surfaces.

2. The game structure as claimed in claim 1 wherein the target structure animates when the front surface of the first target surface is hit by a projectile propelled at the target structure.

3. The game structure as claimed in claim 1 wherein the front surfaces of the first and second target surfaces of the target structure comprise an image of a moving object and the joint is positioned at a point of movement depicted by the image of the moving object.

4. The game structure as claimed in claim 1 further comprising one or more apertures formed in the target structure where the one or more apertures extend through the front surface of the first target surface and through the back surface of the first target surface for receiving a projectile propelled at the target structure.

5. The game structure as claimed in claim 4 wherein the target structure comprises an image of a moving object and the one or more apertures are positioned at one or more moving parts of the image of the moving object.

6. The game structure as claimed in claim 5 wherein a deflecting panel is attached to the target structure covering at least one of the one or more apertures.

7. The game structure as claimed in claim 6 wherein the deflecting panel is moveably attached to the target structure.

8. The game structure as claimed in claim 1 further comprising a stand for supporting the target structure in an upright position.

9. The game structure as claimed in claim 1 wherein the stabilizing arm is removable from the second target surface and the flexible strips fold at the joint placing the target structure into a transport position.

10. The game structure as claimed in claim 9 further comprising a carrying structure attached to the target structure.

11. The game structure as claimed in claim 1 further comprising a ballast located at a base of the target structure.

12. The game structure as claimed in claim 11 wherein the ballast is a storage compartment.

13. The game structure as claimed in claim 1 further comprising one or more skirts secured to the target structure and extending from the front surface of the first target surface to the front surface of the second target surface across the joint to conceal the joint at the front surfaces of the first and second target surfaces.

14. The game structure as claimed in claim 4 further comprising one or more cover panels secured to the target structure and wherein at least one of the one or more cover panels is a deflecting panel at the at one of the one or more apertures.

15. The game structure as claimed in claim 1 further comprising one or more cover panels wherein the one or more cover panels conceal a stand, a bin, a carrying structure, or a ballast.

16. The game structure as claimed in claim 1 wherein the second target surface remains rigid when the first target surface is animated.

17. The game structure as claimed in claim 16 wherein the stabilizing arm moves with the first target surface and the stabilizing arm moves independent of the second target surface when the first target surface is animated.

18. The game structure as claimed in claim 1 wherein the first target surface is positioned above the second target surface when in an upright position.

19. The game structure as claimed in claim 4 wherein one or more bins are attached to the back surface adjacent the one or more apertures for catching projectiles.

* * * * *